US005276982A

United States Patent [19]

Wittmann

[11] Patent Number: 5,276,982

[45] Date of Patent: Jan. 11, 1994

[54] DEVICE FOR ADJUSTING THE FORWARD LEAN OF THE UPPER OF A SKI BOOT

[75] Inventor: Walter Wittmann, Köflach, Austria

[73] Assignee: Koflach Sport Gesellschaft m.b.H. & Co. KG, Wagrain, Austria

[21] Appl. No.: 838,197

[22] PCT Filed: Jul. 11, 1991

[86] PCT No.: PCT/AT91/00085

§ 371 Date: Mar. 6, 1992

§ 102(e) Date: Mar. 6, 1992

[87] PCT Pub. No.: WO92/00682

PCT Pub. Date: Jan. 23, 1992

[30] Foreign Application Priority Data

Jul. 11, 1990 [AT] Austria ..... 1477/90

[51] Int. Cl.[5] ..... A43B 5/04

[52] U.S. Cl. ..... 36/120; 36/117

[58] Field of Search ..... 36/117-121; 36/109, 505

[56] References Cited

U.S. PATENT DOCUMENTS

| | | | |
|---|---|---|---|
| 3,543,421 | 2/1969 | Ader | 36/121 |
| 3,633,291 | 1/1972 | Caporicci | 36/121 |
| 3,945,134 | 3/1976 | Ramer | 36/118 |
| 4,060,256 | 11/1977 | Collombin et al. | 36/117 |
| 4,404,758 | 9/1983 | Kopp | 36/121 |
| 4,455,769 | 6/1984 | Fritsch | 36/121 |
| 4,519,149 | 5/1985 | Pozzobon | 36/121 |
| 4,761,899 | 8/1988 | Marxer | 36/121 |
| 4,905,385 | 3/1990 | Perrissoud | 36/121 |
| 5,101,581 | 4/1992 | Hilgarth | 36/121 |

FOREIGN PATENT DOCUMENTS

| | | |
|---|---|---|
| 182973 | 8/1985 | European Pat. Off. . |
| 2341283 | 9/1977 | France . |

*Primary Examiner*—Steven N. Meyers
*Assistant Examiner*—Thomas P. Hilliard
*Attorney, Agent, or Firm*—Nixon & Vanderhye

[57] ABSTRACT

In a device for adjusting the forward lean of upper (3) of a ski boot with a pull and pressure piece (6), which is supported on bottom shell (1) and upper or cuff (3), in which the distance of supporting surfaces (11, 12) on pull and pressure piece (6) interacting with upper or cuff (3) is adjustable for support on bottom shell (1) in lengthwise direction of pull and pressure piece (6), supporting surfaces (11, 12) interacting with upper or cuff (3) interact through the interposition of a damping element (13) made from elastomeric plastic or rubber with an upper and a lower stop face (14, 15) on upper or cuff (3).

11 Claims, 3 Drawing Sheets

DEVICE FOR ADJUSTING THE FORWARD LEAN OF THE UPPER OF A SKI BOOT

BACKGROUND AND SUMMARY OF THE INVENTION

The invention relates to a device for adjusting the forward lean of the upper of a ski boot with a pull and pressure piece, which is supported on the bottom shell and the upper or the cuff, and the distance of the supporting surfaces on the pull and pressure piece interacting with the upper or the cuff is adjustable for support on the bottom shell in lengthwise direction of the pull and pressure piece.

Devices for adjusting the forward lean of the upper of a ski boot of the above-mentioned type are described, for example, in AT-PS 384 351. In this known design, elastomer components were placed inside a housing designed in the manner of a shock absorber, and the change of the basic setting for the forward lean of the upper becomes possible because the component was released completely from the anchorings, whereupon a cuff was screwed on a male thread by rotating the housing of the shock-damping component, so that the effective length and thus the basic setting of the forward lean could be changed. Altogether, the damping component according to Austrian patent 384 351 represented a relatively expensive and complicated component, in which a basic change of the damping properties for the forward-lean delimitation was possible only by complete dismantling of the component and replacement of damping elements or springs incorporated in the component.

The object of the invention now is to provide a simple device, which can be placed in the smallest space, of the above-mentioned type, with which the possibility is provided to change in a simple way the damping properties starting from a basic setting of the desired forward lean of the upper. Special importance is attached to the circumstance that not only a spring pretension is to be changeable, as is possible in a number of forward-lean delimitations, but that actually the damping can be matched exactly to the respective requirements without big components being necessary for this purpose. To achieve this object, the device according to the invention basically consists in that the supporting surfaces interacting with the upper or the cuff interact through the interposition of a damping element made from elastomeric plastic or rubber with an upper and a lower stop face on the upper or the cuff. Since a relatively small damping element is placed directly between stop faces on the upper or the cuff and supporting surfaces of the pull and pressure piece, a damping element, accessible and exchangeable in a simple way, is made possible, and since the supporting surfaces on the pull and pressure piece are adjustable in the lengthwise direction of the pull and pressure piece, a simple forward-lean adjustment is made possible in a conventional way. The arrangement of an easily accessible damping element directly between the surfaces interacting with one another in this case in no way affects the simple adjustment of the forward lean in a conventional way, and in addition, through the interposition of such a damping component, a slight change of the damping properties is made possible by exchange of the component or other orientation of the component.

According to a preferred further development of the device according to the invention, the design is made so that the supporting surfaces, interacting with the upper or the cuff, are made by a nut that can be rotated on a male thread of the pull and pressure piece, in particular a milled nut. In this way, as known from other forward-lean adjustments, the basic setting of the forward lean can be changed by simple rotation of a nut, in particular a milled nut, and the damping properties starting from the basic setting selected in each case are no longer dependent on the selection of the corresponding material for the interconnected damping element or on the orientation of the damping element in the free space between the nut that can be rotated and the counterstop faces on the upper or the cuff.

According to an advantageous further development of the device according to the invention, the design is made so that the damping element is designed as a component that can be slipped from behind on the pull and pressure piece with an opening for an operating link for the adjustment of the supporting surfaces on the pull and pressure piece, in particular the milled nut. Such a damping element, that can be slipped on from behind, can be removed from behind again in a simple way, if this is desired, and can be replaced by a correspondingly small other damping element with other damping properties.

The fastening of such a damping element can take place in an especially simple way so that the damping element, when it is slipped on the pull and pressure piece, interacts with a detachable locking member, in particular at least one locking pin movable parallel to the pull and pressure piece. The design of the detachable locking member as a movable locking pin can be used in particular if, as corresponds to a preferred further development, two locking pins operable separately from one another are placed laterally to the pull and pressure piece, which engage in recesses on the periphery of the damping element or in bores of the damping element parallel to the pull and pressure piece, to make possible a folding movement of the slipped-on damping element by moving a locking pin. When disengaging a locking pin, the entire damping member can thus be swiveled over the supporting surfaces on the pull and pressure piece, in particular on the milled nut around the axis of the second locking pin, so that in the swiveled-out position, a smaller cross section of the damping element is available for the damping than in the swiveled-in position. A swiveling of the damping member thus produces a continuous change of the damping properties without changing the material of the damping element and after disengaging the second movable locking pin, the damping element can be completely removed and replaced by a damping element with other material properties. In an especially advantageous way, the damping element is thus designed so that the damping element above and below the supporting surfaces on the pull and pressure piece consists of materials, different from one another, with elastic or damping properties different from one another, by which a change of the damping properties in forward or backward direction is possible in a simple way by rotating the damping element about 180° and again slipping on this damping element.

To avoid overstressing the support points of the pull and pressure piece on the bottom shell and on the cuff or the upper, the design is advantageously made so that the pull and pressure piece is hinged directly with an anchor piece in the bottom shell, and such a design in a simple way also offers the possibility of completely releasing the forward-lean delimitation, to be able to swivel the upper into a walking position. To make possible such a complete release to achieve a walking position, the design is advantageously made so that the anchor piece is mounted axially movable in the bottom shell in a recess of the bottom shell and so that the anchor piece is held in at least one moving position by a detachable locking member, and preferably the detachable locking member of the anchor piece is made by a locking bolt movable crosswise to the axis of the anchor piece, which can be attached in a position engaged with a recess or hole of the anchor piece and a position disengaged from the anchor piece. In such a release of the anchor, the anchor piece can be freely moved in axial direction, so that a more extensive swiveling of the upper in the backward-lean direction and thus an upright walking position can be achieved in a simple way.

The stop faces for the supporting surfaces of the pull and pressure piece on the cuff or the upper can be designed in a simple way integral with the upper or the cuff as a flange, which comprise a recess for the passage of the pull and pressure piece, by which a closed outside contour is formed after the insertion of the damping element.

The invention is explained in more detail below based on an embodiment diagrammatically represented in the drawing.

DETAILED DESCRIPTION OF THE DRAWINGS

Figure 1:
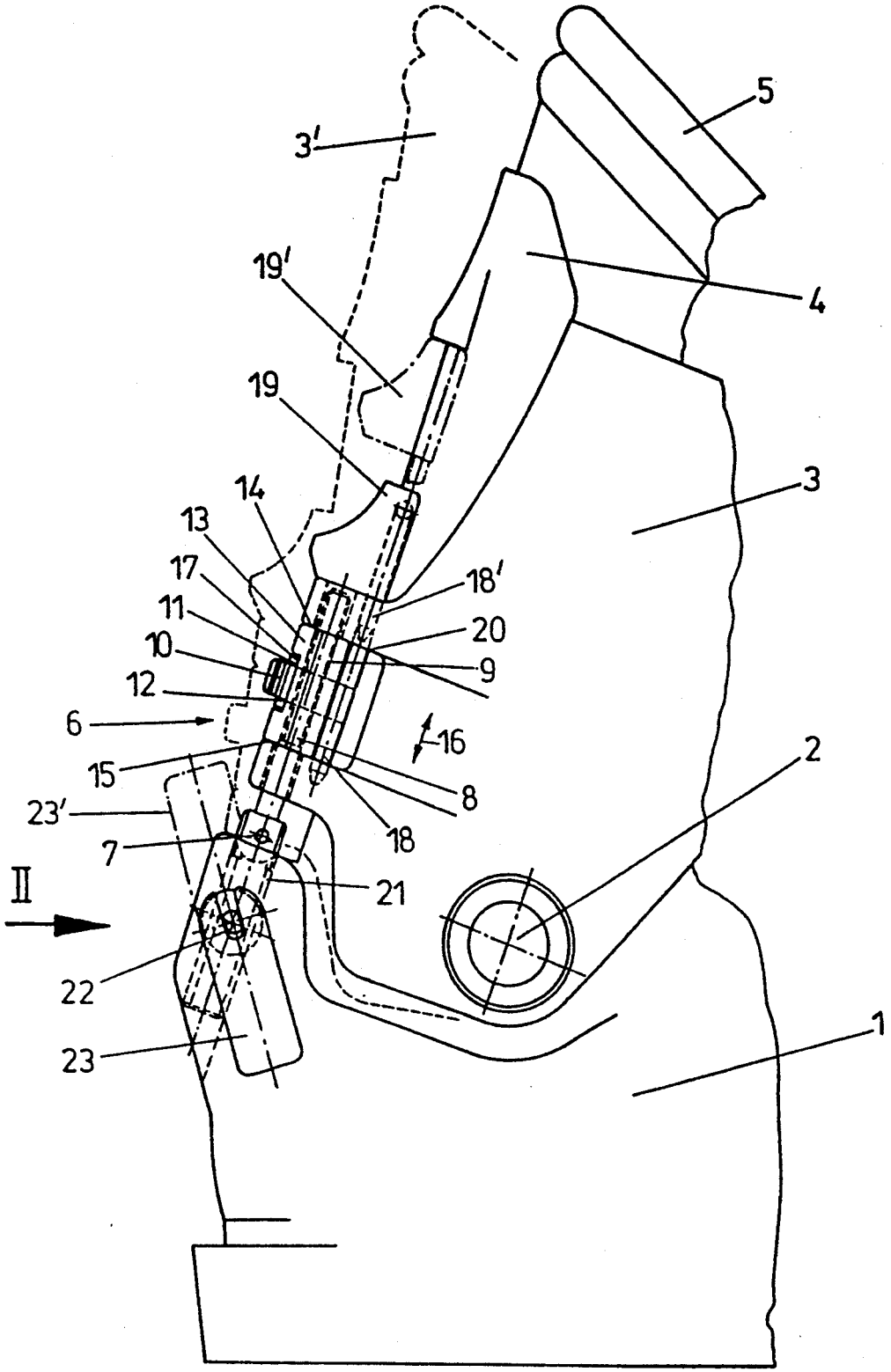
FIG. 1 shows a partial side view of a ski boot with the device according to the invention for adjusting the forward lean of the upper.

In the case of the ski boot represented in FIG. 1, a cuff or an upper 3 is hinged to swivel on a bottom shell or shell 1 around an axis 2 in the ankle area. A support 4 is attached to cuff 3 and the inner shoe of the ski boot is indicated with 5.

For a delimitation of the swiveling movement of upper or cuff 3 relative to shell 1, a pull and pressure piece 6 is provided which is formed with a male thread 9 by a spindle 8, hinged around an axis 7 to swivel on shell 1 and attached in upper or cuff 3, and a milled nut 10 that can be screwed on or adjusted to this male thread. Milled nut 10 in this case forms supporting surfaces 11 and 12, which interact through the interposition of a damping element 13 made from elastomeric material or rubber with an upper stop face 14 and a lower stop face 15 on upper or cuff 3. By an adjustment of milled nut 10 in the direction of double arrow 16, the forward lean, i.e., the pivot position of upper or cuff 3 is set relative to shell 1. By damping element 13, a corresponding damping of the movement of upper or cuff 3 relative to shell 1 is made possible in the respectively adjusted forward-lean position. Damping element 13 is slipped on from behind by the pull and pressure piece formed from worm drive 8 and milled nut 10 and exhibits a recess 17 for a passage of the milled nut, whose end surfaces interact with stop faces 11 and 12 on the milled nut. The fixing of the position of damping element 13 takes place by locking pins or bolts 18 movable basically in lengthwise direction of the pull and pressure piece, which are movable by slides 19 in the rear area of upper or cuff 3 or backward-lean support 4. The released position is indicated in this case with 18' or 19'. Locking pins 18 interact with recesses 20 in the lateral area of damping element 13.

In addition to the adjustment of the forward lean of upper or cuff 3 relative to shell 1 in the case of an adjustment of milled nut 10 and the damping of the forward-lean movement in the case of an adjusted forward-lean position by damping element 13 insertable between supporting surfaces 11 and 12 of milled nut 10 or of the pull and pressure piece and stop faces 14 and 15 on upper or cuff 3, the possibility exists of a release of the forward lean set by the pull and pressure piece. For this purpose, an anchor piece 21, which is formed, for example, from a cuff and which carries swivel axis 7 of spindle 8 of pull and pressure piece 6, is movable in shell 1 in axial direction. In this case, a locking bolt 22 interacts with a corresponding recess of the anchor piece or cuff 21 and gets into a position engaged with the corresponding recess or hole of anchor piece 21, by which an axial movability of the anchor piece and thus of the pull and pressure piece is prevented. In a second position, bolt 22 becomes disengaged from the corresponding recess or hole and thus makes possible an axial movability of anchor piece 21, by which a large area of swiveling of upper or cuff 3 relative to shell 1 is possible. The operation of locking bolt 22 takes place by a lever 23, and the completely drawn-in position of lever 23 and upper or cuff 3 corresponds to the locked position, while after a folding of lever 23 into position 23', indicated by broken lines, of locking bolt 22 becomes disengaged from the recess or hole of the cuff or anchor piece 21 and makes possible a swiveling of upper or cuff 3 into position 3' indicated by broken lines, which facilitates walking with the ski boot.

Figure 2:
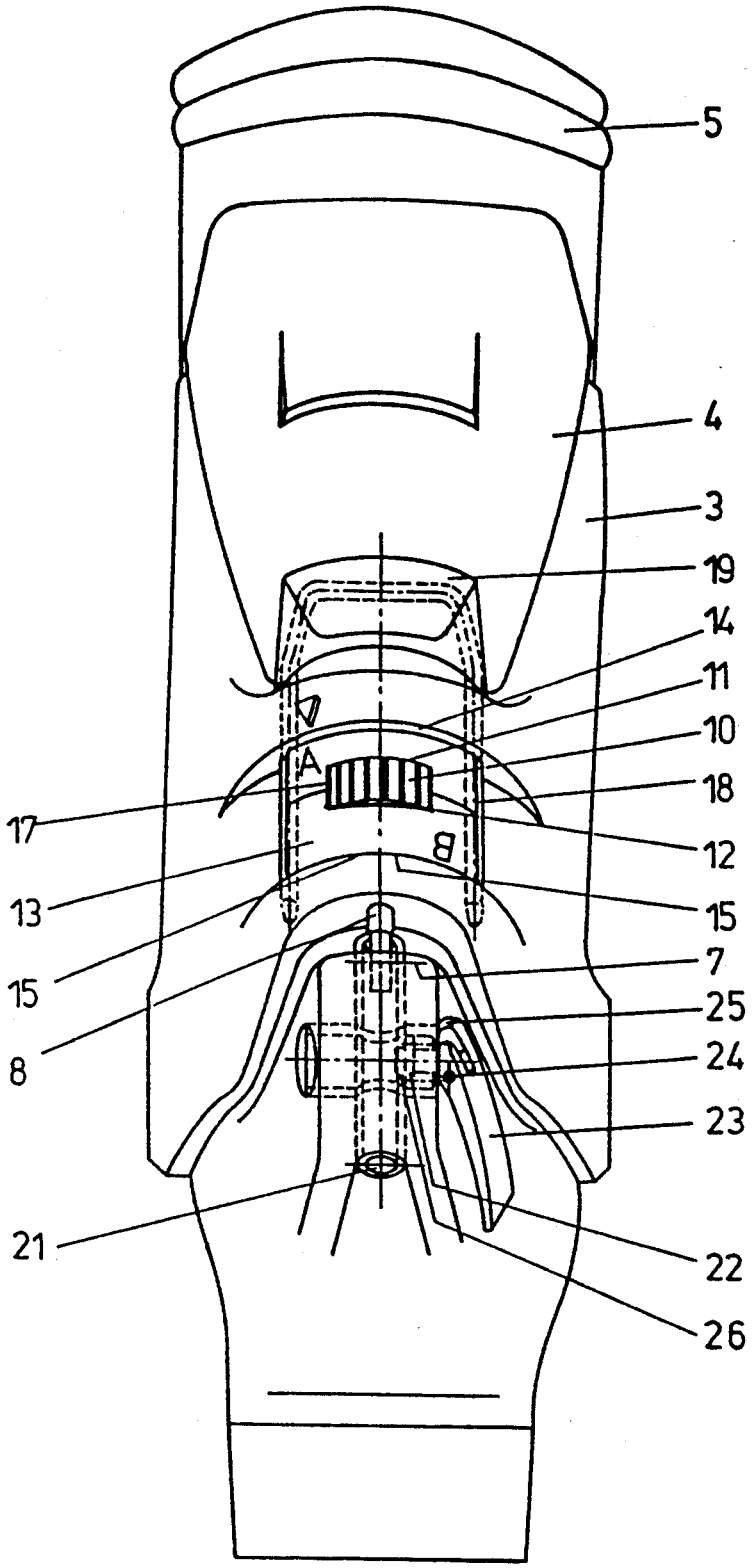
FIG. 2 shows a rear view of the ski boot according to FIG. 1 in the direction of arrow II of FIG. 1.

In the representation according to FIG. 2, the reference symbols of FIG. 1 were maintained for the same components. Damping element 13 comprises areas indicated by the identification "A" and "B," of various damping properties or material properties above and below recess 17 for milled nut 10, so that with appropriate selection of the material of damping element 13, various damping properties for the forward-lean movement and the backward-lean movement can be achieved. A simple change of the damping properties can in this case be made in that after disengaging locking bolts 18, the damping element is rotated by 180° and thus the damping properties are changed for the forward-lean or backward-lean movement. Of course, a damping element can be replaced by another damping element with modified damping properties. Since the fastening of damping element 13 by locking pins or bolts 18 guarantees a reliable fastening of the damping element slipped on by milled nut 10 or the pull and pressure piece, for example, two damping elements can be used instead of a damping element 13 completely surrounding the milled nut in the top view on the rear side of the ski boot, two elements whose dimensions correspond, for example, to the areas corresponding to "A" and "B" in FIG. 2. In this way, in using a large number of damping elements with various damping or material properties, a greatly increased number of combination possibilities of the damping properties is produced for the forward-lean and backward-lean movement.

From FIG. 2, the possibility of releasing the anchor piece or cuff 21 of the pull and pressure piece can be seen in more detail. By lever 23, whose swivel axis 24 is placed eccentrically to front part 25 of lever 23 interacting with the surface of the shell, a removal of locking bolt 22 from a recess 26 in anchor piece 21 takes place so that in a swivel from the position of lever 23 represented in FIG. 2, the head of bolt 22 becomes disengaged from recess 26 and thus, a moving of the anchor piece or cuff 21 in their lengthwise direction by a relatively large path of movement is made possible.

Figure 3:
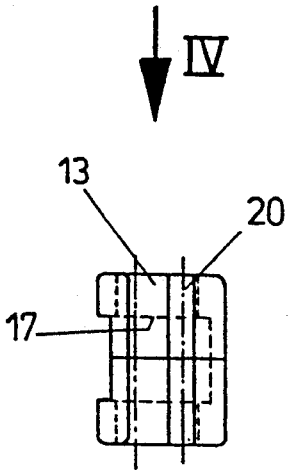
FIG. 3 shows a side view of the damping element of FIG. 1 that can be slipped on the pull and pressure piece.
Figure 4:
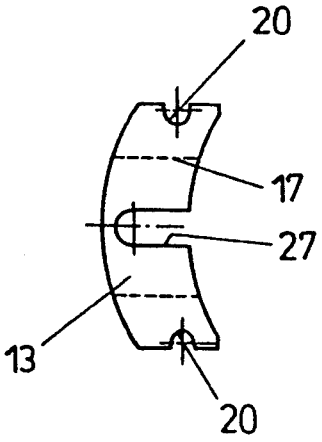
FIG. 4 shows a view in the direction of arrow IV of FIG. 3 on the damping element.

In FIGS. 3 and 4, damping element 13 is represented separately. It can clearly be seen in particular from FIG. 4, how damping element 13 matched to the outside contour of upper or cuff 3 with a recess 27 engages the spindle of the pull and pressure piece, not represented in more detail, and the opening for the milled nut is indicated in turn with 17. The recesses interacting with locking pins 18 are designated with 20.

Locking bolts or pins 18 are movable independently of one another, as indicated in FIG. 2, by the slides in a suitable way, so that after disengaging a pin, a swiveling of damping element 13 can be performed, so that with the corresponding matching of damping element 13, the damping properties can be further influenced by selecting the value of the areas of damping element 13 interacting with stop faces 11, 12, 14 and 15.

I claim:

1. A ski boot having a bottom shell and an upper hinged to the bottom shell for forward and rearward pivotal movement about an axis; and an integral device for adjusting forward lean of said upper relative to said bottom shell, said integral device comprising an elongated, threaded spindle attached at one end to said upper and at an opposite end to said bottom shell; said upper formed with upper and lower stop faces through which said spindle extends, said upper and lower stop faces having a space therebetween; a damping element located within said space and in engagement with said upper and lower stop faces; an adjustment nut threadably secured to said spindle and projecting through a recess in said damping element; and means enabling removal of said damping element without disassembly of said spindle or said adjustment nut.

2. The ski boot of claim 1 wherein said means includes a pair of laterally spaced, elongated recesses extending substantially parallel to said spindle, and a pair of corresponding locking pins mounted in said upper and slidable in respective ones of said two additional recesses to a release position enabling installation and removal of said damping element.

3. The ski boot of claim 1 wherein said damping element comprises separate pieces engaging said upper and lower support surfaces, said separate pieces comprised of different materials having different damping characteristics.

4. The ski boot of claim 1 wherein said threaded spindle is hinged to said bottom shell by means of an axially movable anchor, said axially movable anchor held in an operative position by a locking element interacting with a recess in said axially movable anchor.

5. A ski boot having a bottom shell and an upper hinged to the bottom shell for forward and rearward pivotal movement about an axis, a device for adjusting forward lean of said upper relative to said bottom shell, the device comprising an elongated threaded spindle attached at one end to said upper and hinged at an opposite end to said bottom shell, said spindle extending between upper and lower spaced stop faces formed in said upper; a damping element located between said upper and lower stop faces, said damping element having a first recess therein; and an adjustment member threadably mounted on said threaded spindle and extending through said first recess in said damping element, and wherein said adjusting member is formed with upper and lower support surfaces adapted to interact with said upper and lower stop faces, via said damping element, to thereby adjust the forward lean of said upper relative to said bottom shell upon rotation of said adjustment member in either of two opposite directions.

6. The device according to claim 5 wherein said adjustment member comprises a nut.

7. The device according to claim 5 wherein said damping element is formed with at least one additional recess for receiving a corresponding locking pin slidably mounted in said upper and in substantially parallel relationship with said spindle, wherein said locking pin is slidable to a release position to enable installation and removal of said damping element.

8. The device according to claim 5 wherein said damping element is formed with two additional laterally spaced, elongated recesses extending substantially parallel to said spindle, and a pair of corresponding locking pins mounted in said upper and slidable in respective ones of said two additional recesses to a release position enabling installation and removal of said damping element.

9. The device of claim 5 wherein said damping element comprises separate pieces engaging said upper and lower support surfaces, said separate pieces comprised of different materials having different damping characteristics.

10. The device of claim 5 wherein said threaded spindle is hinged to said bottom shell by means of an axially movable anchor, said axially movable anchor held in an operative position by a locking element interacting with a recess in said axially movable anchor.

11. The device of claim 10 wherein said locking element comprises a bolt movable crosswise to an axis of the anchor, said bolt movable into and out of engagement with said recess in said axially movable anchor.

* * * * *